US008137247B2

(12) United States Patent
Gerschefske et al.

(10) Patent No.: US 8,137,247 B2
(45) Date of Patent: Mar. 20, 2012

(54) EXERCISE APPARATUS WITH RESILIENT FOOT SUPPORT

(75) Inventors: Kevin Gerschefske, Rogersville, MO (US); Robert McDonial, Ozark, MO (US)

(73) Assignee: Stamina Products, Inc., Springfield, MO (US)

( * ) Notice: Subject to any disclaimer, the term of this patent is extended or adjusted under 35 U.S.C. 154(b) by 0 days.

(21) Appl. No.: 12/686,306

(22) Filed: Jan. 12, 2010

(65) Prior Publication Data

US 2011/0172069 A1 Jul. 14, 2011

(51) Int. Cl.

| | |
|---|---|
| ***A63B 5/11*** | (2006.01) |
| ***A63B 21/068*** | (2006.01) |
| ***A63B 21/00*** | (2006.01) |
| ***A63B 26/00*** | (2006.01) |

(52) U.S. Cl. ..... 482/96; 482/27; 482/135; 482/142

(58) Field of Classification Search ..... 482/23, 482/26–29, 51, 55–56, 74, 77, 92–96, 121, 482/129–131, 133–135, 142, 909
See application file for complete search history.

(56) References Cited

U.S. PATENT DOCUMENTS

| | | | |
|---|---|---|---|
| 338,638 | A | 3/1886 | Goldie |
| 382,319 | A | 5/1888 | Norton et al. |
| 1,996,350 | A | 4/1935 | Schaff |
| 4,077,623 | A | 3/1978 | Clausell |
| 4,272,074 | A | 6/1981 | Sferle |
| 4,468,025 | A | 8/1984 | Sferle |
| 4,477,070 | A | 10/1984 | Appelbaum |
| 4,564,193 | A | 1/1986 | Stewart |
| 4,685,669 | A | 8/1987 | DeCloux |
| 4,700,946 | A | 10/1987 | Breunig |
| 4,706,953 | A | 11/1987 | Graham |
| 4,722,520 | A | 2/1988 | Lee |
| 4,796,882 | A | 1/1989 | Jiumr |
| 4,836,530 | A | 6/1989 | Stanley, Jr. |
| 4,884,802 | A | 12/1989 | Graham |
| 4,911,438 | A | 3/1990 | Van Straaten |
| 4,928,957 | A | 5/1990 | Lanier et al. |
| 4,974,840 | A | 12/1990 | Welch |
| 5,066,005 | A | 11/1991 | Luecke |

(Continued)

OTHER PUBLICATIONS

The Merriam-Webster Dictionary, http://www.merriam-webster.com/dictionary/snap?show=1&t=1293826366, definition of "snap".*

*Primary Examiner* — Loan Thanh
*Assistant Examiner* — Oren Ginsberg
(74) *Attorney, Agent, or Firm* — Pillsbury Winthrop Shaw Pittman LLP

(57) ABSTRACT

An exerciser including a movable body support mounted on an exerciser flame for movement along tracks provided by the frame. A movable foot support extends from the exerciser frame. The movable foot support is adapted to be engaged by the user's feet to absorb the energy of movement in a first direction and to provide the user with a bouncing movement, which the user may translate into a movement of the movable body support in the opposite direction. The movable foot support may be provided as an attachment and retrofitted to existing exercisers. The exerciser may include a resilient resistance system coupled to the movable body support and a set of pull lines with user grips trained over pulleys carried by the exerciser frame. Also disclosed are methods for enabling users to exercise.

40 Claims, 12 Drawing Sheets

U.S. PATENT DOCUMENTS 5,071,115 A 12/1991 Welch
5,160,305 A 11/1992 Lin
5,169,363 A 12/1992 Campanaro et al.
5,215,511 A 6/1993 Cheng
5,312,315 A 5/1994 Mortensen et al.
5,338,278 A 8/1994 Endelman
5,364,327 A 11/1994 Graham
5,385,518 A * 1/1995 Turner ..... 482/27
5,445,583 A 8/1995 Habing
5,622,527 A 4/1997 Watterson et al.
5,634,870 A 6/1997 Wilkinson
D382,319 S 8/1997 Gerschefske
5,788,606 A 8/1998 Rich
5,792,033 A 8/1998 Merrithew
5,897,459 A 4/1999 Habing et al.
5,938,571 A 8/1999 Stevens
5,967,955 A 10/1999 Westfall et al.
6,010,434 A 1/2000 Hodges
6,042,523 A 3/2000 Graham
6,135,922 A 10/2000 Nissen
6,186,929 B1 2/2001 Endelman et al.
6,206,809 B1 3/2001 Habing et al.
6,280,367 B1 8/2001 Arsenault
6,338,704 B1 1/2002 Endelman
6,371,895 B1 4/2002 Endelman et al.
6,422,983 B1 7/2002 Week
6,500,099 B1 12/2002 Eschenbach
6,527,685 B2 3/2003 Endelman et al.
6,547,701 B1 4/2003 Eschenbach
6,551,219 B1 4/2003 Brown
6,702,726 B2 3/2004 Lin
6,752,745 B1 6/2004 Davis
7,115,077 B2 10/2006 Yang
7,179,207 B2 * 2/2007 Gerschefske ..... 482/95
7,637,854 B2 12/2009 Jang
7,771,328 B2 * 8/2010 Gerschefske ..... 482/95
2002/0058573 A1 5/2002 Endelman et al.
2002/0183172 A1 12/2002 Chen
2004/0058781 A1 * 3/2004 Plante ..... 482/27
2004/0077464 A1 4/2004 Feldman et al.
2004/0142800 A1 7/2004 Gerschefske
2004/0192522 A1 9/2004 Hippensteel
2004/0209738 A1 10/2004 Crawford et al.
2005/0202943 A1 9/2005 Branch et al.
2005/0272566 A1 12/2005 Otsuka
2006/0094573 A1 * 5/2006 Weck ..... 482/126
2007/0111866 A1 5/2007 McVay
2007/0219053 A1 9/2007 Barufka et al.
2008/0318738 A1 12/2008 Chen
2009/0105046 A1 4/2009 Rudich
2009/0181834 A1 7/2009 Campanaro et al.

* cited by examiner

EXERCISE APPARATUS WITH RESILIENT FOOT SUPPORT

BACKGROUND OF THE INVENTION

This application relates to methods of exercising and to exercise apparatuses with resilient foot supports for carrying out those methods. In particular, this application relates to those types of devices and methods described in U.S. Pat. No. 5,967,955, and U.S. Patent Des. 382,319, herein incorporated by reference in their entirety.

SUMMARY OF THE INVENTION

One aspect of the invention relates to a method of enabling a person to exercise. The method comprises providing a movable body support for the exercising person which supports the exercising person in a position which allows the body of the exercising person to move with the movable body support while the feet of the exercising person are free to be moved with respect to the movable body support and providing a movable foot support separate from the body support in a position to be engaged by the feet of the exercising person supported on the movable body support. The method also comprises providing for the absorption of the energy of the movement of the movable body support in a first direction away from the movable foot support by the exercising person supported thereon and the conversion of the absorbed energy to a movement of the movable body support with the exercising person supported thereon in a second direction toward the movable foot support. Additionally, the method comprises providing for the controlled yielding of the movable foot support caused by the engagement thereof by the feet of the exercising person moving with the movable body support in the second direction and establishing as a result of the controlled yielding a bouncing movement by the movable foot support in the first direction, which the exercising person can translate into a movement of the movable body support in the first direction. The arrangement is such that the exercising person can control the repetition and magnitude of the movements of the movable body support by flexure of the legs at the knees.

Another aspect of the invention relates to an exerciser. The exerciser comprises of a frame assembly, a movable body support disposed on the frame assembly and constructed and arranged to support the body of an exercising person in a position which allows the body of the exercising person to move with the movable body support while enabling the feet of the exercising person to be free to be moved with respect to the movable body support, and a movable foot support disposed on the frame assembly and constructed and arranged to be engaged by the feet of the exercising person supported on the movable body support. The movable body support is mounted on said frame assembly for movement in a first direction away from the resiliently movable foot support and a second direction toward the movable foot support, and is constructed and arranged to absorb the energy of a movement thereof in the first direction by a user supported thereon and to convert the absorbed energy into a movement thereof with the exercising person supported thereon in the second direction. The resiliently movable foot support is constructed and arranged to yield resiliently in response to the engagement of the feet of the user moving with the movable body support in the second direction and to establish, as a result of the resilient yielding, a bouncing movement by the resiliently movable foot support in the first direction, which can be translated by the user into a movement of the movable body support in said first direction.

A further aspect of the invention relates to an attachment for an exerciser of the type including a movable body support disposed on a frame assembly in a position to support the body of an exercising person in a position which allows the body of the exercising person to move with the movable body support while enabling the feet of the user to be free from the movable body support, a foot assembly adapted to be mounted on the frame assembly in a position to be engaged by the feet of the exercising person supported on said movable body support, and mounting structure disposed on the frame assembly, the mounting structure being constructed and arranged to detachably mount the foot assembly to the frame structure. The attachment comprises a movable foot support constructed and arranged to cooperate with the mounting structure to be mounted on the frame assembly in lieu of the foot assembly in a position to be engaged by the feet of a user supported on the movable body support. The movable foot support is constructed and arranged to yield resiliently in response to the engagement of the feet of the user supported on the movable body support therewith in a second direction toward the movable foot support and to establish, as a result of the resilient yielding, a bouncing movement by the movable foot support in a first direction which can be translated by the user into a movement in said first direction of said movable body support.

Yet another aspect of the invention relates to a resilient foot support including a frame having a connector structure constructed and arranged to connect the frame to an exercise apparatus; and a flexible sheet member that removably and releasably couples to the frame, wherein said flexible sheet member is constructed and arranged to be engaged by the feet of a person and to yield resiliently to provide a bouncing movement, in response to movement of the person. The resilient foot support may include a sheet assembly that envelopes the frame.

Other aspects of the invention will become apparent from the following description.

BRIEF DESCRIPTION OF THE DRAWINGS

The invention will be described with reference to the following drawings, in which like numerals represent like features throughout the figures, and in which:

FIG. 2A is a perspective view; FIG. 2B-2C are front plan views; FIG. 2D is a cross-sectional view taken along line 2D-2D in FIG. 2C, and FIG. 2E is a rear plan view;

FIG. 3 is a rear plan view and FIGS. 4A and 4B are alternative cross-sectional views taken alone line 4-4 in FIG. 3;

FIG. 5 is an front plan view, and FIGS. 6A-6C are alternative cross-sectional views taken along line 6-6 in FIG. 5.

DETAILED DESCRIPTION

Figure 1:
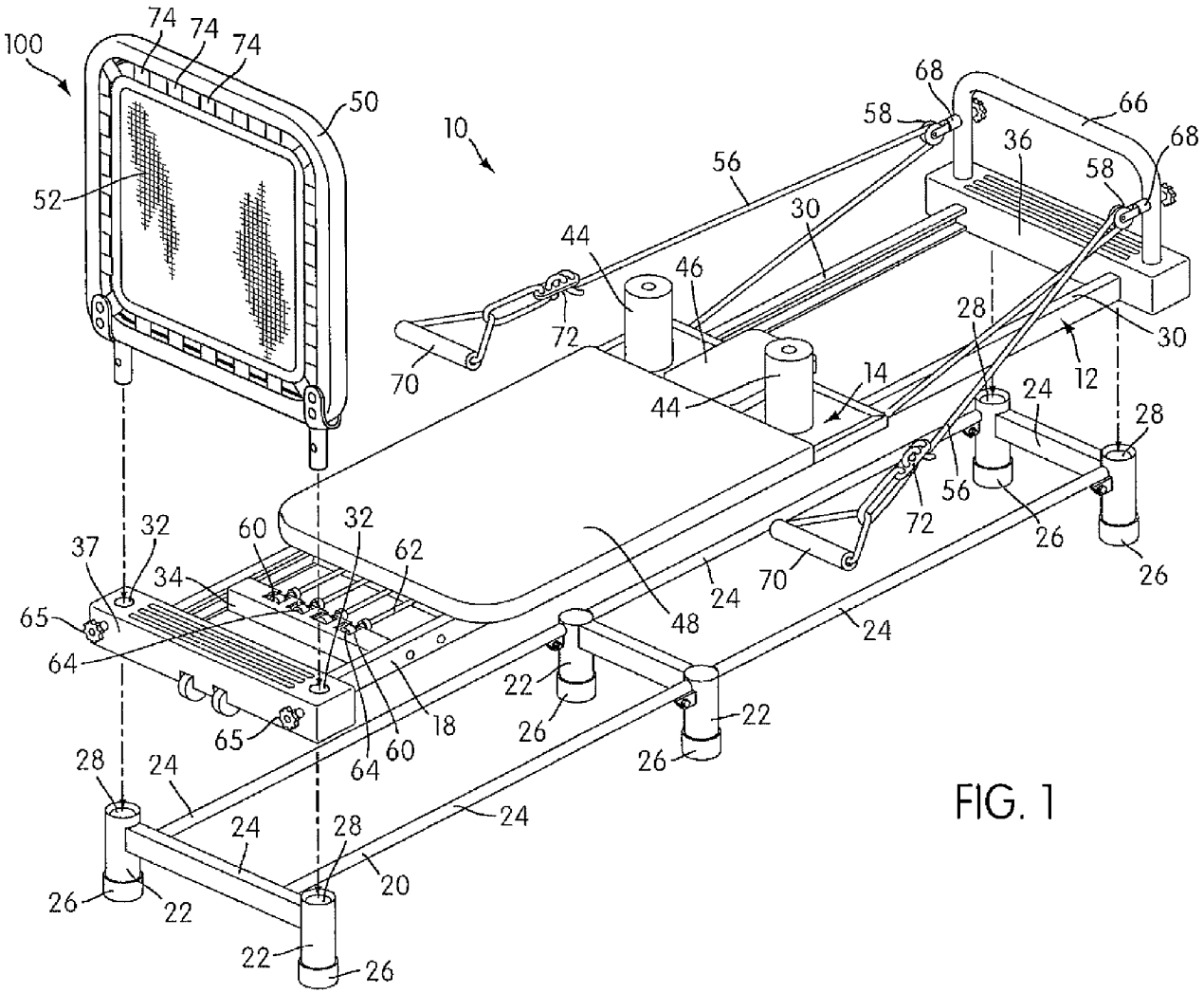
FIG. 1 is an exploded view of an exerciser according to an embodiment of the present invention.

FIG. 1 is an exploded view of an exerciser apparatus, generally indicated at 10, according to one embodiment of the invention. The exerciser 10 is generally of the type shown in U.S. Patent Des. 382,319, which was incorporated by reference above. The exerciser 10 includes a frame assembly, generally indicated at 12, a translationally movable body support, generally indicated at 14, disposed on the frame assembly 12 in a position to support the body of the user (not shown) in a position enabling the feet of the user to be free from the movable body support 14, and a resiliently movable foot support or trampoline assembly, generally indicated at 100, constructed and arranged to be mounted on the frame assembly 12 in a position to be engaged by the feet of the user supported on the movable body support 14.

The frame assembly 12 includes a frame 18, which is adapted to support the movable body support 14, the foot support assembly 100, and the user, as well as a stand 20, which is adapted to connect to the frame 18 to hold the frame 18 in a generally horizontal plane above floor level. As is shown in FIG. 1, the stand 20 comprises a plurality of legs 22 connected at respective upper ends thereof by cross bars 24, such that the stand portion 20 is comprised of generally rectangular or trapezoidal segments having legs 22 disposed at the corners of the segments. End caps 26 of a rubber or other non-skid material may be provided at floor-contacting ends of the legs 22. Upper receptacle sections 28 of the stand 20 are adapted to receive corresponding mating structures provided on the underside of the frame 18 (not shown in the Figures), so as to operatively secure the frame 18 to the stand 20. The legs 22 of the stand 20 may be of any length that provides a convenient user height for the frame portion 18.

Depending on the embodiment, the frame 18 and stand 20 may be separable, so that the exerciser 10 can be stored easily. Additionally, the stand 20 may be omitted or sold separately, particularly if the height provided by the stand 20 is not required for the exercises that are to be performed. Moreover, it may be desirable to construct the stand 20 such that one end is wider than the other. A stand 20 with one wider end and one narrower end may be desirable if one end of the exerciser 10 requires a broader base of support to prevent lateral tipping, or if the exerciser 10 is constructed such that the stand 20 will only mate with the frame 18 if the frame 18 is in a particular orientation.

The frame 18 is comprised of two generally parallel support tracks 30, connected and braced by a number of cross members. Each of the support tracks 30 has a generally C-shaped cross-section, such that each support track 30, in the shape of a channel, which is adapted to receive engaging portions of the movable body support 14. The limiting portions of the support tracks 30 define the extent of travel for the movable body support 14. In the exerciser 10, one of the limiting portions is a crossbar 34 that extends between the two support tracks 30; the other limiting portion is defined by an endpiece 36 of the frame portion 18. Alternatively, the limiting portions may simply be the ends of the grooves in the support tracks 30.

Although rollers 33 are used in the illustrated embodiment, a number of bearings and other movement support structures are known in the art, and any one of these known types of bearings may be used in place of the rollers. For example, instead of rollers, blocks of low-friction material may be used, and the inside tracks on the support tracks 30 may be lubricated in order to facilitate sliding movement with reduced friction.

The support tracks 30 may be continuous bars that run the length of the exerciser, or they may be comprised of sets of shorter bars which are secured together by welds or fasteners At one end, tracks 30 connect to an endpiece 36, 37 to form an end of the frame 18 of the exerciser 10. The endpieces 36, 37 of the illustrated embodiment are bars covered with decorative plastic moldings, but they may be made in other configurations.

In alternative embodiments of the invention, the support tracks 30 may have a substantially rectangular cross section, and a movable body support with rollers or other movement support structures may be configured so as to rest on top of the support tracks, rather than engaging inside tracks defined within them. The precise manner of engagement of the movable body support and the support tracks is not critical.

Several body-engaging components are mounted on the movable body support 14 so as to facilitate the body positioning of the user. Two padded shoulder blocks 44, one on each side of the body support 14, extend vertically, and are positioned so as to engage the upper portion of the user's torso (i.e., at the collarbone or shoulder region) when the user is lying prone or supine on the movable body support 14, so as to prevent the user from sliding relative to the movable body support 14 in a direction away from the foot support assembly 100. The shoulder blocks 44 may be removably attached to the movable body support 14, for example, by a threaded connection.

A padded head rest 46 is also mounted on the movable body support 14. In the position illustrated in FIG. 1, the head rest 46 is positioned such that its user-contacting surface is generally horizontal and co-planar with those of the movable body support 14. However, the head rest may be mounted on a multi-position bracket, such that its angular position may be adjusted relative to that of the movable body support so as to support the user's head in an inclined position. In addition to the head rest 46, a torso pad 48 is mounted on the movable body support 14 so as to cover a substantial portion of the movable body support 14 to provide traction and comfort.

When the user is lying on the movable body support 14 in either prone or supine position with his or her head on the head rest, the user's feet are free to move with respect to the movable body support 14, and extend in a direction toward the releasably resilient foot support assembly 100. As can be seen in FIG. 1, in one embodiment, the foot support assembly 100 comprises a generally rectangular peripheral frame member 50 that extends vertically, perpendicular to the orientation of the movable body support 14. Details of the releasable resilient moveable foot support assembly 100 are shown in the subsequent figures and description below.

The exerciser 10 also carries a resilient resistance system coupled to the movable body support 14. The crossbar 34 proximate to the foot support assembly 100 has several slots 60 formed in it. Each slot 60 in the crossbar is sized and adapted to accept one end of a tensile resilient resistance element 62. A bracket on the underside of the movable body support 14 (not shown in the figures) includes a corresponding set of slots 60, each slot 60 adapted to accept the other end of a tensile resilient resistance element 62. In this embodiment, the crossbar 34 and bracket of the movable body support 14 each include four slots 60; however, the number of slots 60 may be selected arbitrarily, depending on the total desired resistance, the width of the crossbar 34 and bracket, and the total amount of space required for each tensile resilient resistance element 62. The exerciser 10 may be operated with any number of tensile resilient resistance elements 62 installed in the slots.

The tensile resilient resistance elements 62 illustrated in FIG. 1 are elastomeric cords with knobs 64 installed at the ends, so that the ends may be seated in the slots provided for them. The tensile resilient resistance elements 62 may also comprise tension coil springs, rubber bands, or similar structures. Depending on the type of tensile resilient resistance elements 62, hooks or other receiving structures may be used instead of slots. As those of skill in the art will appreciate, one of the functions of the tensile resilient resistance elements 62 is to bias the movable body support 14 to return to a position proximate to the movable foot support system 100 when moved by the user away from the movable foot support system 100. However, particularly if the movable body support 14 is inclined and able to move under the influence of gravity, the resilient resistance system may be omitted.

The exerciser 10 of FIG. 1 also carries an aim exercise system. Two pull lines 56 are connected to the underside of the movable body support 14. From the underside of the movable body support 14, the pull lines 56 are routed over pulleys 58 that are carried by an upright bar 66 provided on the end of the exerciser opposite the foot support. The pulleys 58 are adapted to swivel, so as to allow the user to pull the pull lines 56 toward the foot support assembly 100 in a variety of planes of motion. The pulleys 58 are also releasably mounted on the upright bar 66 by mounting structure 68 so that their angle and orientation can be changed by the user.

From the pulleys 58, the pull lines 56 extend towards the foot support assembly 100, and are coupled to user grips 70 at their ends. Between the ends of the pull lines 56 and the user grips 70, take-up fittings 72 are provided. Each take-up fitting 72 has a number of holes formed in it, such that if the pull lines 56 are too long, they may be wrapped around and through the take-up fittings 72 to reduce their effective lengths. When the user grips the user grips 70 and causes the pull lines 56 to extend, he or she is working against the force bias provided by the tensile resilient resistance elements 62. The arm exercise system, including the pull lines 56, pulleys 58 and associated structures is an optional feature, and may not be included in some embodiments of the invention.

The foot support assembly 100 is constructed and adapted to yield in a controlled manner in response to the engagement of the user's feet therewith in a direction toward the foot support system 100 and to establish, as a result of the controlled yielding, a bouncing movement by the foot support assembly 100 in the opposite direction, which can be translated by the user into a movement of the movable body support 14 in that opposite direction. In this context, the term "bouncing movement" may refer to movements during which the feet of the user lose contact with the foot support assembly 100, as well as resilient movements during which the feet of the user remain in contact with the foot support assembly 100. The term "feet" may refer to both of the user's feet together or to one individual foot; the exercises shown described here may be performed with one foot, each foot alternately, or both feet simultaneously. The terms "controlled yielding" and "resilient yielding" imply that the foot support system 100 or individual foot portions thereof yield in such a manner that they are biased to return to their original position.

By the operation of the resilient resistance system, the movable body support 14 is constructed and arranged to absorb the energy of movement of the user on the movable body support in a direction away from the foot support system 100 and to convert that absorbed energy into a movement toward the foot support system 100.

The user may control the degree of resistive bias by changing the number of tensile resistance elements 62 that are connected between the crossbar 34 and the movable body support 14. The pull lines 56 are constructed and arranged such that forces applied in a direction toward the foot support system 100 by the user's arms are converted into movements of the movable body support 14 away from the foot support system 100. Alternatively, the user may control the position of the movable body support 14 solely by flexure of the legs against the foot support system 100.

A user may lie on the movable body support 14 in an essentially supine position, flexed at the knees, with the bottoms of his or her feet in contact with the flexible sheet member 52 of the foot support system 100. User may also grip the user grips 70, and extend the pull lines 56 forwardly. As the user moves the movable body support 14 towards the foot support system 100, this causes the flexible sheet member 52 to deflect. The resiliency of the elastomeric cords 74 attached to the flexible sheet member 52 causes the flexible sheet member 52 to rebound, creating a bouncing movement by the foot support system 100 that the user can translate into a movement of the movable body support 14.

The actual amount of bouncing or resiliency will vary with the type of flexible sheet member 52 and elastomeric cords 74 that are used, as well as the way in which the user controls the movement. The movements may be repeated any desired number of times at any desired frequency.

During the movements, the feet of the user may or may not lose contact with the foot support system 100, depending on how the user controls the movement. If the feet of the user do lose contact with the foot support system 100 during the bouncing movement, the separation distance may be at least partially controlled by the user by exerting the muscles of the legs and/or abdomen appropriately when initially contacting the foot support system 100 or thereafter.

The exerciser 10 may be used for a number of different types of exercise. In particular, the user may exercise using any combination of arm, leg, or arm and leg movements. If the user uses both arm and leg movements during the exercise motions, the effects of the arms and legs on the movement of the movable body support 14 are additive. The use of the foot support system 100 may be particularly helpful in exercising the abdominal muscles, because the flexed-knee position of the user will cause some of the exercising forces to be absorbed by and/or exerted by the abdominal muscles.

In addition to being installed on and included with an exercise machine like that shown in FIG. 1, a foot support according to the invention may also be sold and used as a separate attachment constructed and arranged to be installed or retrofitted on an exercise apparatus in lieu of a conventional foot bar or foot support. In the exercisers described above, the foot support system 100 may be a unitary structure that provides a single surface for contacting both of the user's feet. However, in other embodiments of the invention, individual foot supports, or individual contact areas, may be provided for each foot.

FIGS. 2A-2E show a releasable resilient foot support system 100 in accordance with an embodiment.

The releasable resilient foot support system 100 generally includes a replaceable sheet assembly 80 that is configured to be removeably and reattachably coupled to a rigid frame 50, without damage to the sheet assembly or the frame. When it is desired to change or replace the sheet assembly 80, the sheet assembly 80 may be removed from the frame, and replaced, by sliding the sheet assembly 80 off of and onto the frame 50. In some implementations, one or more handles (not shown), may be provided to assist a person in sliding the sheet assembly. Handles could be located, for example, at opposite ends of the sheet assembly 80, or at other locations.

In one embodiment, the sheet assembly 80 may include: support structure 81, flexible sheet member 82, and one or more resilient members 83 coupling the flexible sheet 82 to the support structure 81.

The frame 50 may define the perimeter of the resilient foot support system 100. In some implementations, the frame 50 may be rectangular, square, round, oval, U-shaped, or other shapes. In a U-shaped configuration, for example, a top portion 51 of the frame 50 (opposite the connecting structure or portions 102) may be omitted.

The resilient foot support system 100 may be sold or used as an attachment for exerciser 10 (FIG. 1). The frame 50 may include cylindrical connecting structures or portions 102 for connecting the foot support 100 with appropriate receptacles 32 provided in the exercise apparatus 10. Depending on the configuration of the exerciser 10, the connecting structures 102 may simply be the terminal portions of the frame member 50. Connecting structures 102 may be welded or otherwise joined to the frame 50. Alternatively, they could be keyed or shaped shafts, or could include some other structure adapted to cooperate with the receptacles 32 of the exerciser to lock the foot support system 100 into position within the exerciser 10. As shown, in FIG. 1, screws 65 may be provided in endpiece 37 (and/or other locations) onto which a user can manually screw or unscrew to secure (or unsecure) the foot support system 100 to the frame 50 of the exerciser 10. Additionally, connecting structures 102 may include thru-holes 101 for which screws 65 passes through. The thru-holes 101 could also include internal threads (not shown). Other attachment devices could also be used for securing the foot support system 100 to the exerciser 10.

The sheet assembly 80 may also include one or more gussets or deformable portions that are configured to yield slightly to help the sheet assembly 80 more easily slide over the frame 50. This may further help urge the flexible sheet member 82 into a tightened or taut condition when the sheet assembly 80 is slid over the frame. For example, the flexible sheet member 82 could be stretched when the sheet assembly 80 is slid over the frame 50.

The center portion of the frame 50 may be open to accommodate movement of the flexible sheet member 82 with respect thereto. Frame 50 may be composed of one or more solid or hollow elements and can be made of a metal, such as steel or aluminum, or other rigid material.

It will be appreciated that the frame 50 could also be a standalone system. For example, the frame 50 could be a part of a trampoline unit, usable with or without an exerciser apparatus, such as disclosed in U.S. Patent Application Publication No. 2007/0219053, herein incorporated by reference in its entirety. In some embodiments, the frame 50 may include legs (not shown) or other supports which are configured to support the frame 50 above the ground in an elevated manner if desired.

Figure 2A:
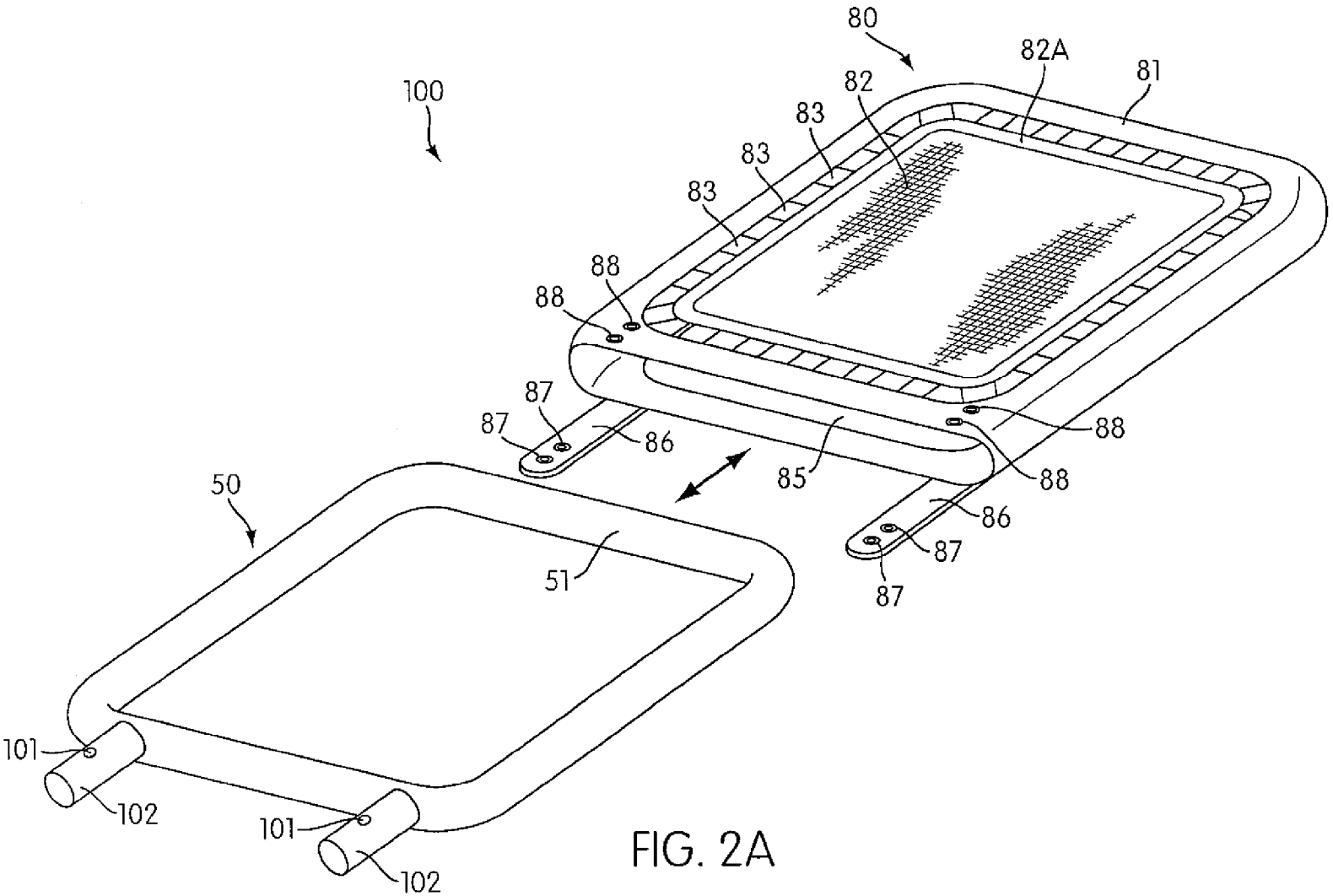
FIG. 2A-2E show a schematic of one releasable resilient foot support system according to another embodiment, where
Figure 2B:
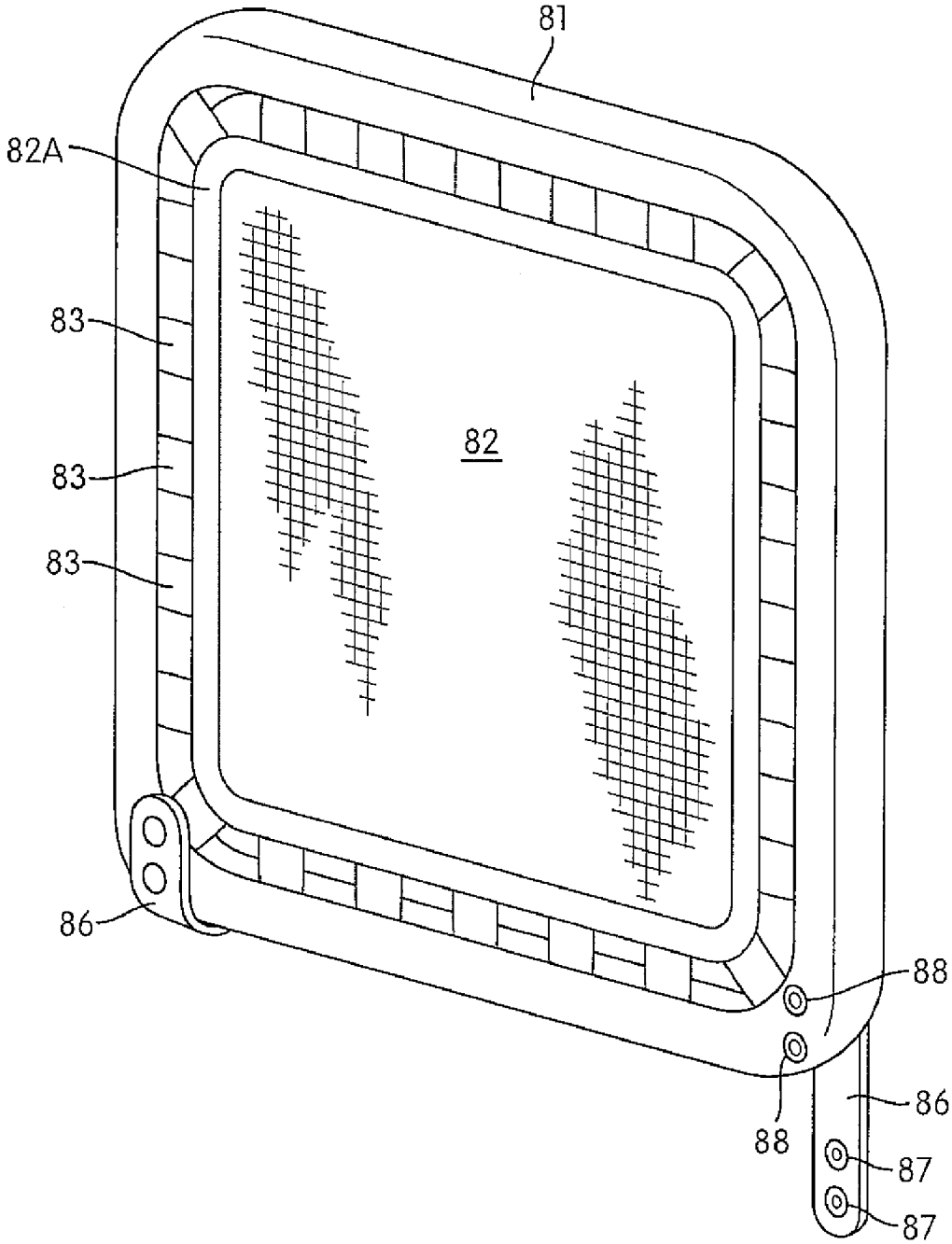
Figure 2C:
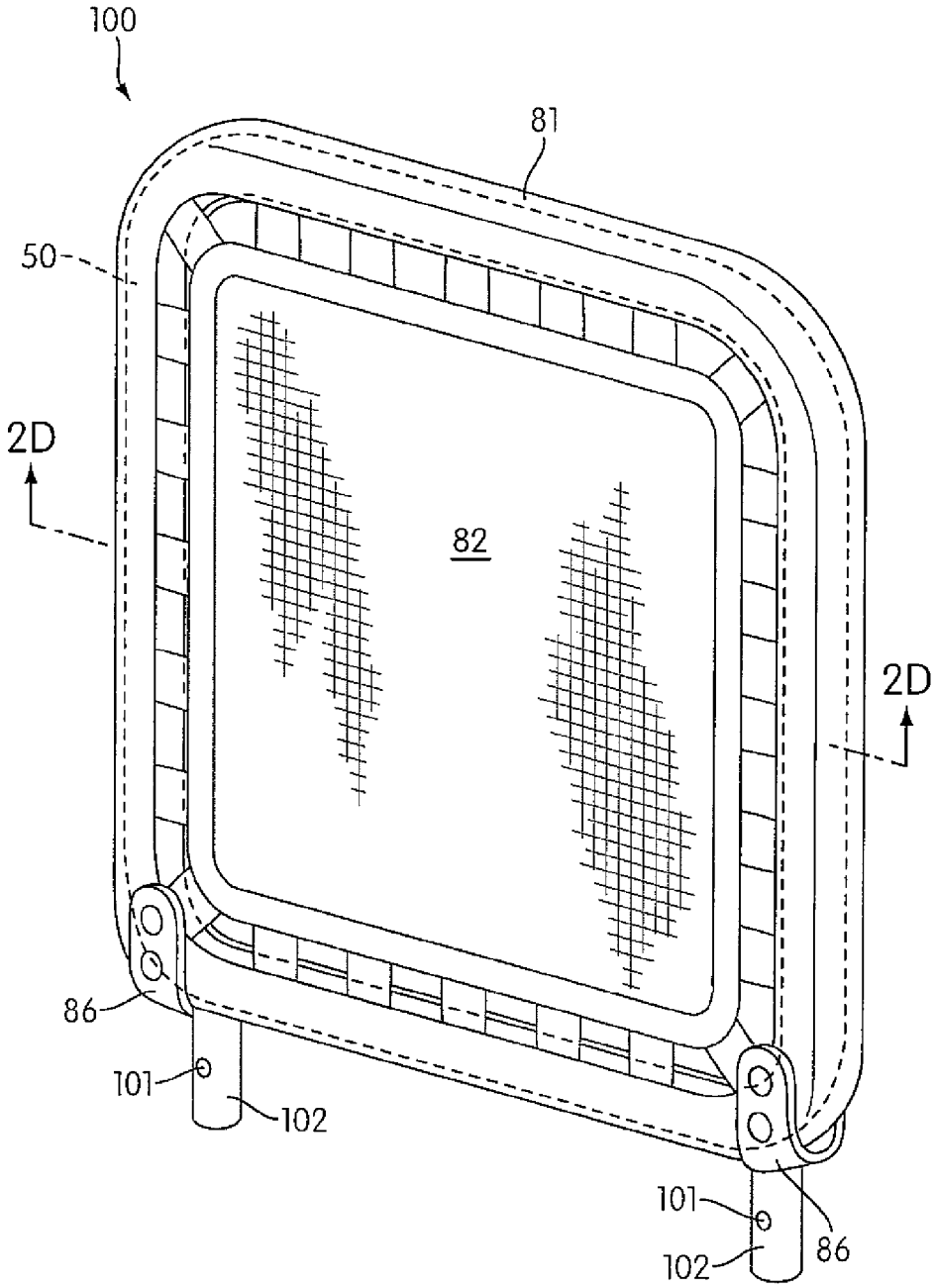
Figure 2D:
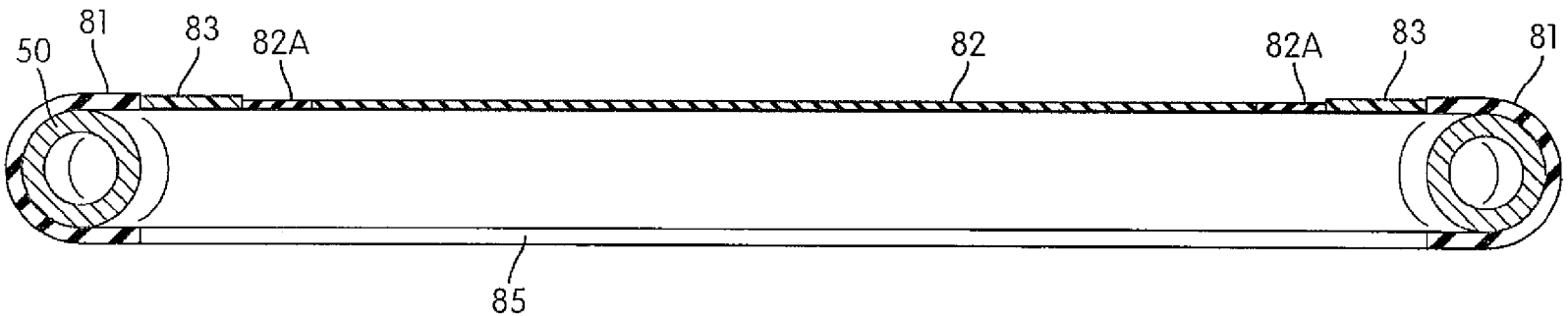
Figure 2E:
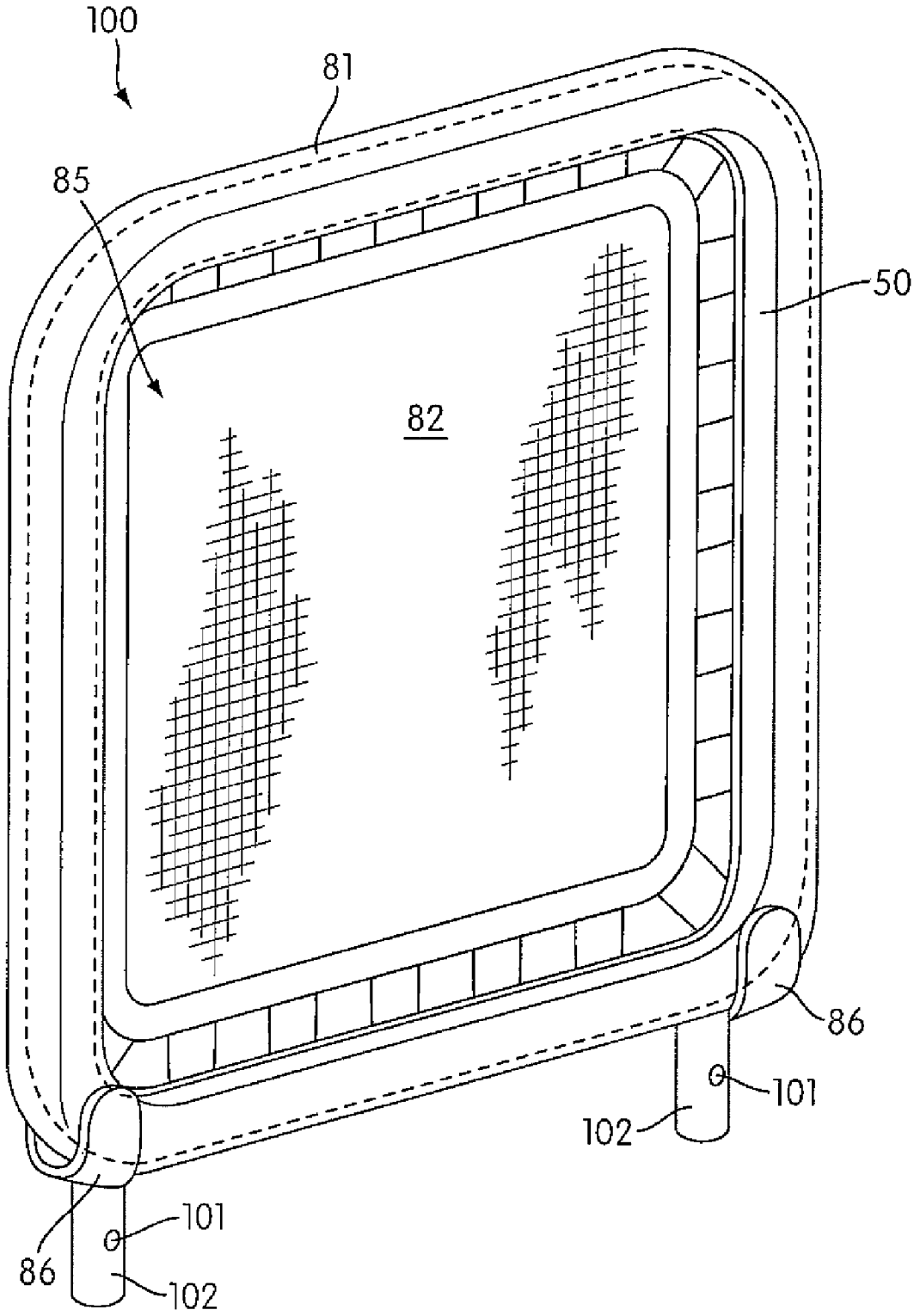

FIGS. 2A and 2B show the frame 50 without the sheet assembly 80, and FIGS. 2C-2E shows the sheet assembly 80 coupled to the frame 50. The sheet assembly 80 may be comprised of a support structure 81 that supports a flexible sheet member 82. Flexible sheet member 82 may be rectangular or square in shape which generally conforms in shape to the frame 50 and be formed of a flexible material, such as an fabric or sheet material which is capable of flexing (or slight deformation). In some instances, flexible sheet member 82 may be resilient and formed from elastic, polymeric (polymer), rubber material or the like, which is capable of deforming and returning to its original shape. The support structure 81 may be formed to conform generally to the perimeter of the frame 50 also. The support structure 81 may be slid onto and off of the frame 50 similar to sliding a glove on and off of a hand.

The flexible sheet member 82 may be coupled to the support structure 81 by one or more coupling elements. For example, the flexible sheet member 82 may include a reinforced border member 82A (e.g., by stitching, adhesive, fasteners, etc.) that couples to one or more resilient members 83 positioned between the flexible sheet member 82 and the support structure 81. Resilient members 83 may include resilient extensible cords, springs, elastic bands, bungee cords, or the like, that may be attached to the flexible sheet member 82 and support structure 81, for instance, by stitching, adhesives, glues, clips, rivets, and/or other type of fasteners.

In order to secure the sheet assembly 80 to the frame 50 and prevent its removal during use, the sheet assembly 80 may be provided with one or more releasable fasteners. The releasable fasteners may include, for instance, one or more of the following, zippers, buttons, clips, snaps, screws, bolts, buckles, straps, pins, hook and loop (or Velcro-type) fasteners, bayonet-type fasteners, toggle fasteners (e.g., similar to cuff-links), and/or other releasable fastening devices. In the embodiment shown, one or more straps 86 may be provided which are configured to wrap around a portion of the frame 50. Straps 86 may also include one or more snaps 87 which engage corresponding snaps 88 provided on the support member 81. The straps 86 wrap around, for instance, from the back surface to the front surface of the sheet assembly 80 and the snaps 87, 88 connect to one another. Straps 86 may be formed of a flexible material, such as leather, fabric, rubber, polymeric (polymer) materials. In some instances, straps 86 may be resilient and stretch in order to secure the sheet assembly 80. The latter connection may also enable the straps 86 to be further tightened snugly, as needed, to maintain the flexible sheet member 82 in a taut condition.

The sheet assembly 80 may include one or more holes, contours and/or cutouts to accommodate the connecting structure 102 and/or legs. For example, FIG. 2C shows that the straps 86 may hold the sheet assembly 80 onto the frame 50 to prevent the sheet assembly 80 from sliding off. The straps 86 allow the connecting structures or portions 102 to stick out past the sheet assembly 80 for coupling with an exerciser 10. If will be appreciated that straps 86 and snaps 87, 88 may be provided at other locations than shown.

FIG. 2D shows a cross-sectional view of the releasably resilient foot support system 100 shown in FIG. 2C. As shown, support member 81 may snugly conform to the contours of the frame 50. Support member 81 may be formed of a rigid or semi-rigid material, such as rubber, polymeric (polymers), leather, etc.

In the illustrated embodiment, the peripheral frame member 50 has a generally circular cross section, and a fabric flexible sheet member 82 is attached to the peripheral frame member 50 by a series of elastomeric, resilient; extensible cords 83. The fabric flexible sheet member 82 may be nylon, canvas, or another suitable fabric capable of withstanding exercising use. The elastomeric, resilient, extensible cords 83 may comprise, for example, an elastomeric rubber encased in a fabric outer casing. In addition to the arrangements herein, the releasable resilient foot support system 100 may be made in a variety of configurations and of a number of materials. For example, elastomeric cords or tension coil springs could be secured at first ends within the interior of a hollow peripheral frame member and could extend from it, being secured to the flexible sheet member at respective second ends. Alternatively, the flexible sheet member 82 itself may be made of a resilient, elastomeric material, such as rubber, and may be secured to support structure 81 with adhesives or other fasteners, without elastomeric cords 83.

The flexible sheet member 82 may be maintained in a generally taut fashion when the sheet assembly 80 is installed over the frame 50. FIG. 2E shows a rear view of the releasable resilient foot support system 100. The opening 85 in the bottom surface the sheet assembly 80, which may generally correspond in shape to the flexible sheet member 82, and may allow the flexible sheet member 82 to displace therein.

Figure 3:
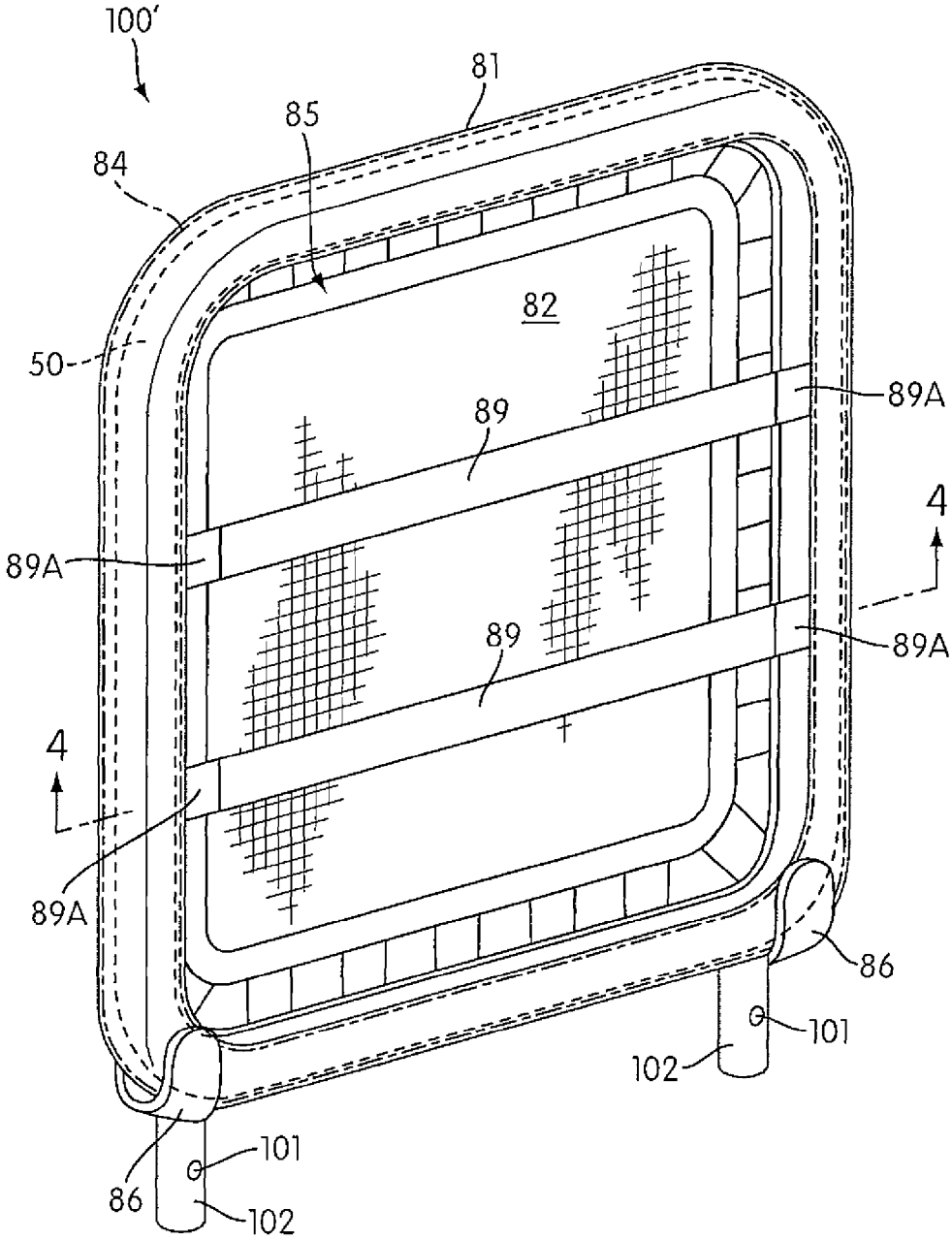
FIGS. 3 and 4A-4B show features of a releasable resilient foot support system according to embodiments, where

FIG. 3 shows a rear plan view of another releasable resilient foot support system 100' in accordance with an embodiment. As shown, one or more straps 89 may also be provided on the back surface of the sheet assembly 80. Straps 89 may be formed of a flexible material, such as leather, fabric, rubber, polymeric (polymer) materials. This may help to further secure the sheet assembly 80 to the frame 50. In some instances, straps 89 may be resilient and stretch to secure the sheet assembly 80. Straps 89 might also be located, for instance, across the corners of opening 85 and/or at other locations (e.g., provided in both horizontal and vertical directions). The ends 89A of the straps 89 may be connected to the lower surface of the sheet assembly 80. Ends 89A could be directly attached to the sheet assembly 80, or may include one or more elements for coupling the straps 89 to the sheet assembly 80, such as snaps, buttons, hook and loop (e.g., Velcro type) fasteners, buckles, or other fasteners. The latter connection may also enable the straps 89 to be further tightened snugly, as needed, to maintain the flexible sheet member 82 in a taut condition.

Figure 4A:
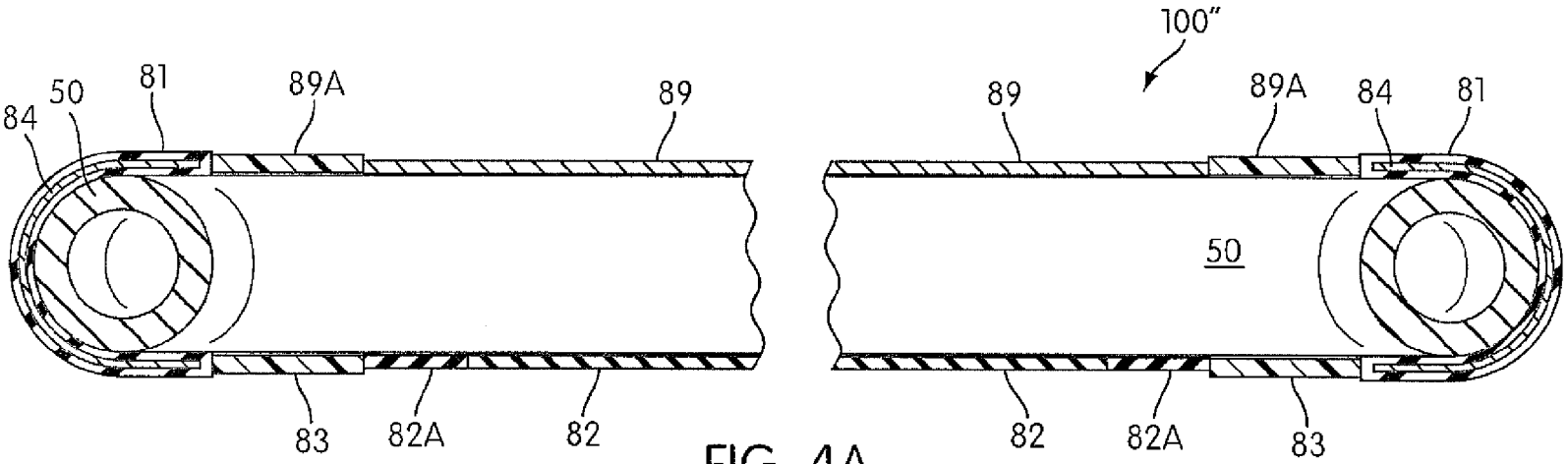

FIG. 4A show a cross-sectional view of the releasable resilient foot support 100' system taken across-line 4-4 in FIG. 3. In addition to or as an alternative to straps 89, the support member 81 may be provided with one or more stiffener members 84. Stiffener members 84 may be arranged and configured to help the support member 81 to withstand deformation of the sheet assembly 80 due to dynamic forces generated by the bouncing movement of a user. Stiffener members 84 may be formed integrally with, and/or attached to the support member 81, such as, for example, formed within the support member 81 (as shown in FIG. 4A), on or the outside of support member 81 or on the inside of support member 81. Or stiffener members 84 could be provided on an internal and/or external surface of the support member 81. Stiffener member 84 may be formed from a metal, such as steel or aluminum, and in one embodiment, can have a shape that closely corresponds to the outer periphery of frame 50 as shown in the Figures, which should not be considered limiting. The stiffener member 84 can have any configuration that helps maintain the sheet member 82 taut. Flexible sheet member 82 may be attached at the upper surface of the sheet assembly 80, as shown, via resilient members 83.

Figure 4B:
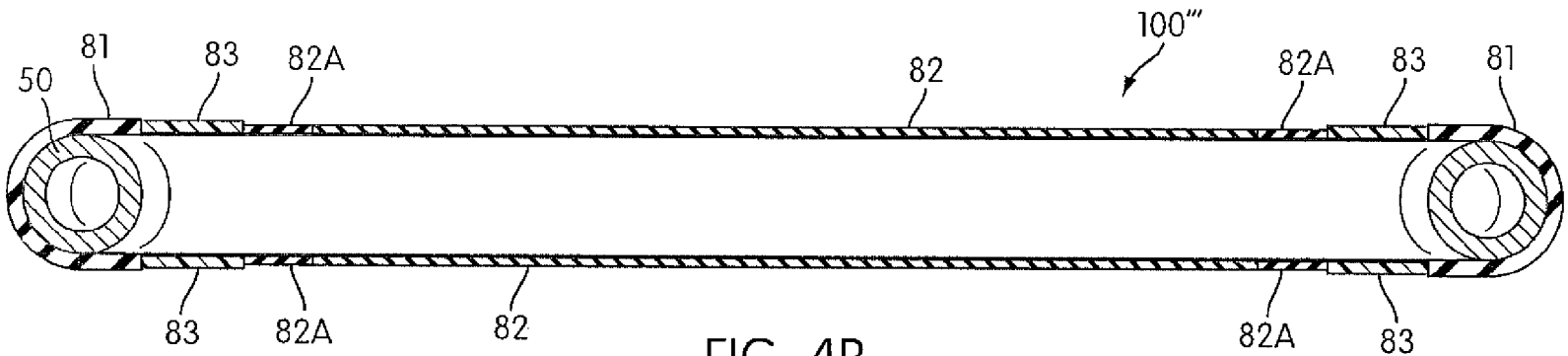

FIG. 4B show an alternate cross-sectional view of releasable resilient foot support system 100" taken across-line 4-4 in FIG. 3. As shown in FIG. 4B, a flexible sheet member 82 may be provided on both the front and back surfaces of the sheet assembly 80. In some implementations, the front and back sheet members 82 could have different resilient or bouncing characteristics. Of course, it is also contemplated that the flexible sheet member 82 could be attached to the back surface of the sheet assembly 80 only or to the front surface of the sleeve only.

Figure 5:
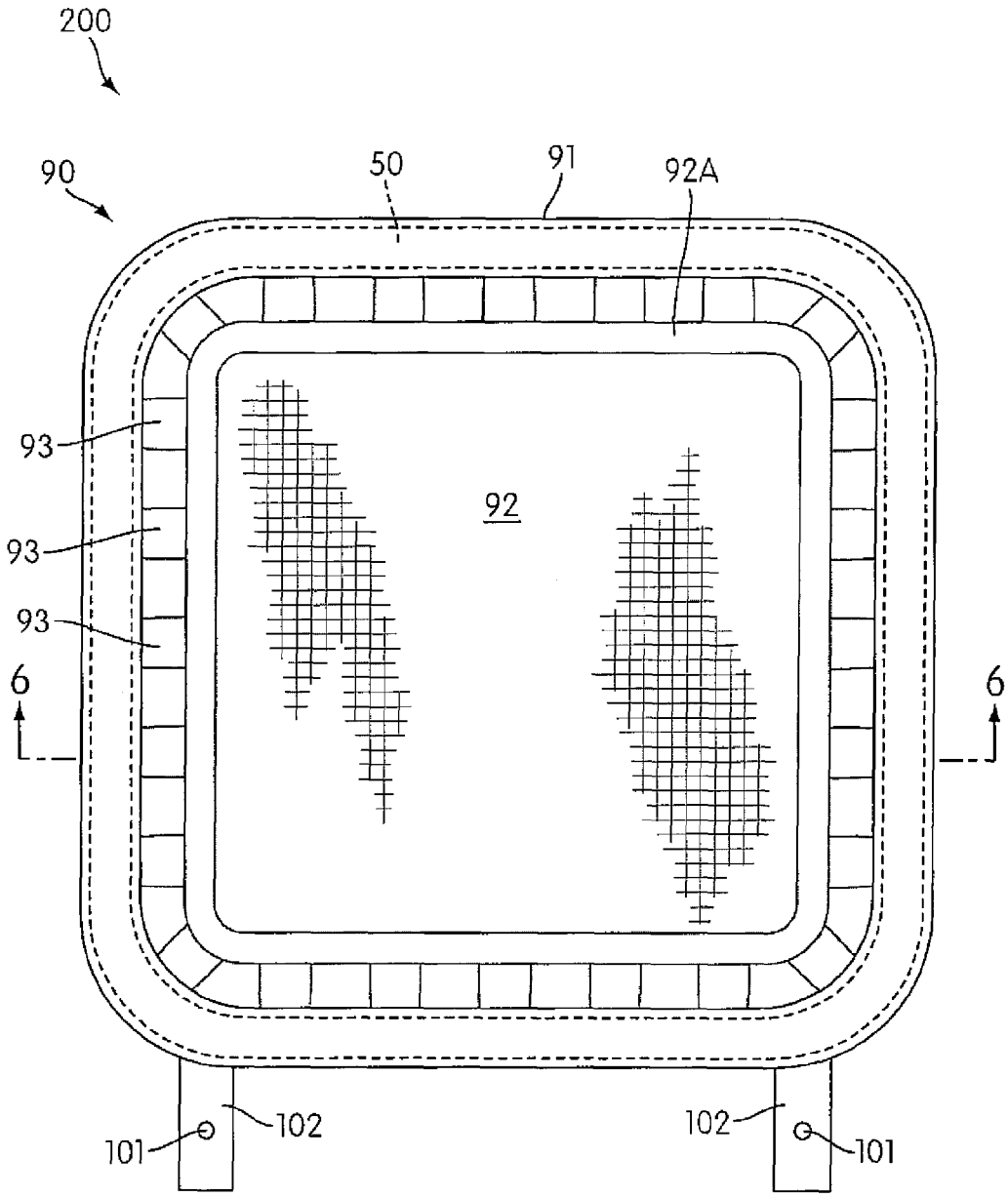
FIGS. 5 and 6A-6C show another releasable resilient foot support system according to embodiments, where

FIGS. 5 and 6 show another releasable resilient foot support system 200 in accordance with an embodiment.

The releasable resilient foot support system 200 generally includes a replaceable sheet assembly 90 that is configured to be removeably and reattachably coupled to a rigid frame 50, without damage to the sheet assembly 90 or the frame 50. The releasable resilient foot support system 200 may be used similarly as releasably resilient foot support system 100. Unlike the sheet assembly 80 of the foot support system 100, discussed above, which generally envelopes the frame 50, a more planar or flat releasable sheet assembly 90 is provided, that is configured to be removably (without damage) and reattachably coupled to a frame 50. The sheet assembly 90 may generally include a support member 91 that supports a flexible sheet 92.

When it is desired to change or replace the sheet assembly 90, the existing sheet assembly 90 may be removed from the frame 50, and replaced, by a new or different sheet assembly 90.

The frame 50 may define the perimeter of the resilient foot support system 200. In some implementations, the frame 50 may be rectangular, square, round, oval, U-shaped or other shapes, as discussed above. Frames 50 of the foot support systems 100, 200, may be interchangeable in some implementations, but need not be. Further, the sheet assembly 90 could be stretched before attaching it to the frame 50 to put it in a tightened or taut condition. Stretching could be performed manually or with a stretching apparatus.

The center portion of the frame may be open to accommodate movement of the flexible sheet member 92 with respect thereto. Frame 50 may be composed of one or more solid or hollow elements. In addition, the frame 50 may include support and/or mounting structure, such as connecting structures or portions 102, that are configured to removably and reattachably couple the frame 50 to an exercise apparatus 10.

The support structure 91 may conform generally to the perimeter of the frame 50. The support structure 91 may be placed on top and/or the bottom of the frame 50. Or in other embodiments, it may be smaller than the frame 50, and attached within the confines of the frame 50.

The flexible sheet member 92 may be coupled to the support structure 91 directly, or as shown, include one or more coupling elements. For example, the flexible sheet member 92 may include a reinforced border member 92A that couples to one or more resilient member 93. The flexible sheet member 92 may be attached to the support structure 91 by resilient members 93. Resilient members 93 may include extensible cords, springs, bungee cords, or the like, that may be attached to the support structure 91 for instance by stitching, adhesives, glues, rivets, and/or clips, other fastening means. In some implementations, the flexible sheet member 92 might be directly attached to the support structure 91. For example, flexible sheet member 92 may be attached at the upper surface of the sheet assembly 90, as shown. Of course, the flexible sheet member 92 might also be attached to the lower surface only, or both surfaces of the sheet assembly 90. In some implementations, the top and bottom sheet members 92 could have different resilient characteristics.

Figure 6A:
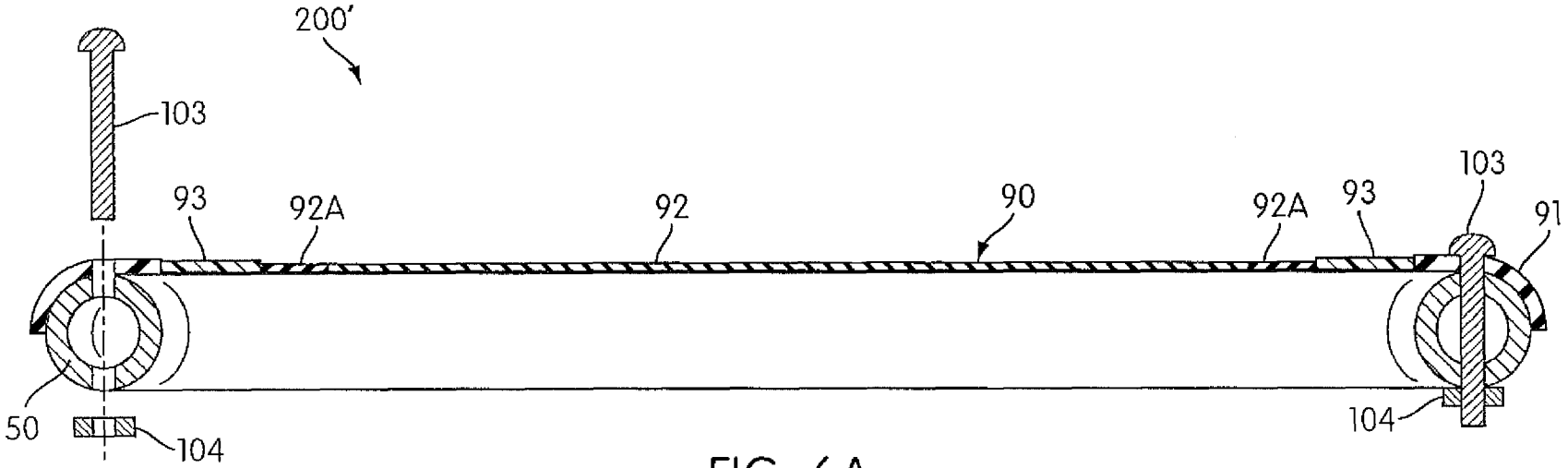
Figure 6B:
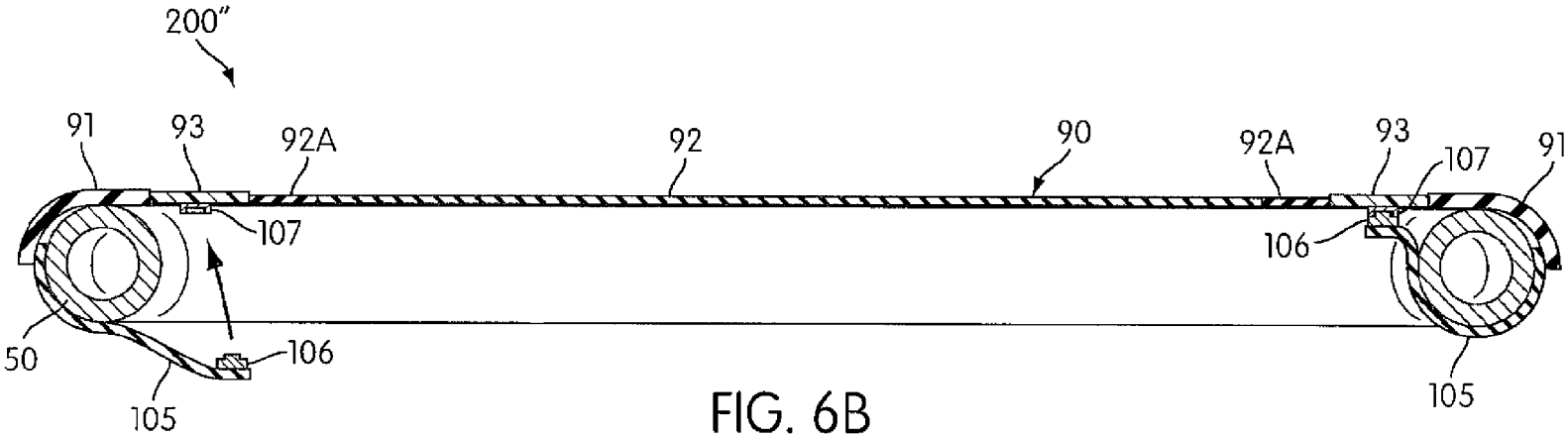
Figure 6C:
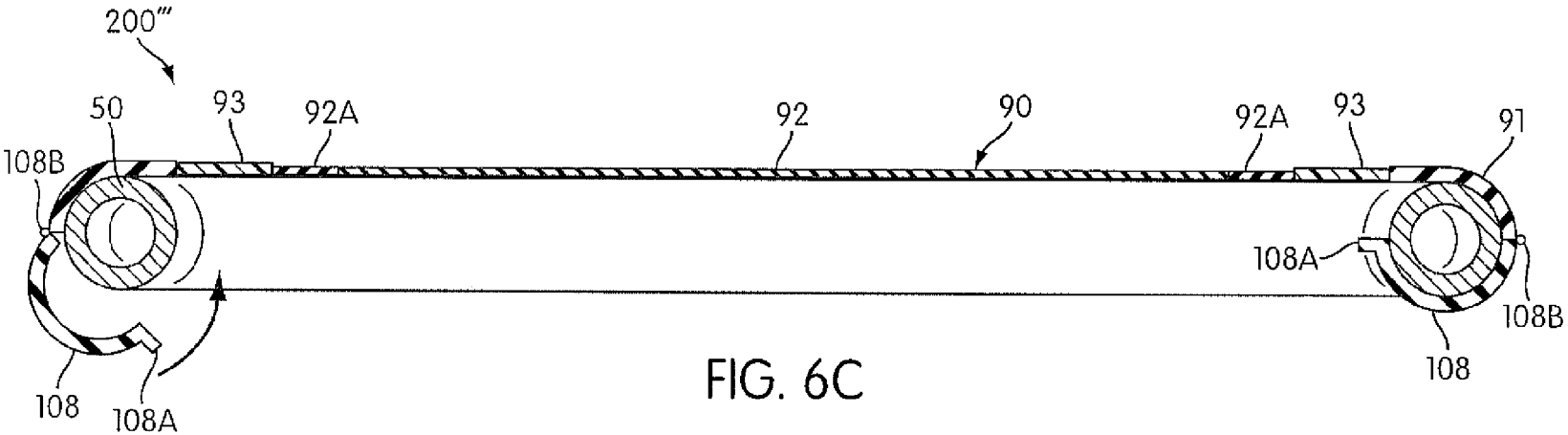

FIGS. 6A-6C are cross-sectional views showing various exemplary embodiments for coupling the replaceable sheet assembly 90 to the frame 50 taken across line 6-6 in FIG. 5. FIG. 6A shows releasable resilient foot support system 200' where the support structure 91 may couple to the frame 50 with one or more fasteners. As shown, one or more bolts 103 may pass through holes in the support structure 91 and corresponding holes in the frame 50. Each bolt 103 may include a corresponding nut 104 to releasably and reattachably secure the support structure 91 to the frame 50. FIG. 6B shows releasable resilient foot support system 200" where the support member 91 may include one or more straps 105 having one or more snaps 106. Straps 105 may wrap around the frame 50 and the snaps 106 on the straps 105 may engage corresponding snaps 107 provided on a lower surface of the support member 91. Straps 105 may be further tightened to maintain the flexible sheet member 92 in a taut condition.

FIG. 6C shows releasable resilient foot support system 200" where the support member 91 may include one or more clips or clamps 108. In one embodiment, as illustrated, the clips 108 are arranged and configured to engage the frame 50.

In some implementations, the frame 50 may have slots, or other portions that are configured for engagement with the clips 108. For different frame configurations, the clip shape and/or construction may vary. In another embodiment (not shown), no hinge 108B is provided. Instead, clips 108 may be a "C-clip" formed of a resilient material such as metal (e.g., spring steel) which are configured to elastically yield when force is applied, but return to a closed configuration when the force is removed.

Clips 108 can bend or flex backwards, e.g., manually via tabs 108A to open, and the resiliency of the clips 108 will urge them to close to engage and secure against the frame 50. Similarly, to remove the clip 108 from the frame 50, the clips 108 can be bent backwards, e.g., manually via tabs 108A to open the clip 108 and to disengage it from the frame 50. A spring-loaded hinge 108B may be provided to further help the clip 108 return to a closed configuration. In some instances, clip 108 might also have a friction-enhancing surface (e,g., a knurled or scored surface) to engage the surface of the frame 50. Additionally, a pin or other element (not shown) may be inserted into the clip 108 to maintain it in a closed position.

It will be appreciated though, of course, that other releasable fastener devices might also be used to couple the sheet assembly 90 to the frame 50. These may include, for instance, zippers, buttons, clips, screws, pins, hook and loop (or Velcro-type) fasteners, bayonet fasteners, toggle fasteners (e.g., similar to cuff-links), magnetic fasteners, and/or other releasable fastening means.

Figure 7:
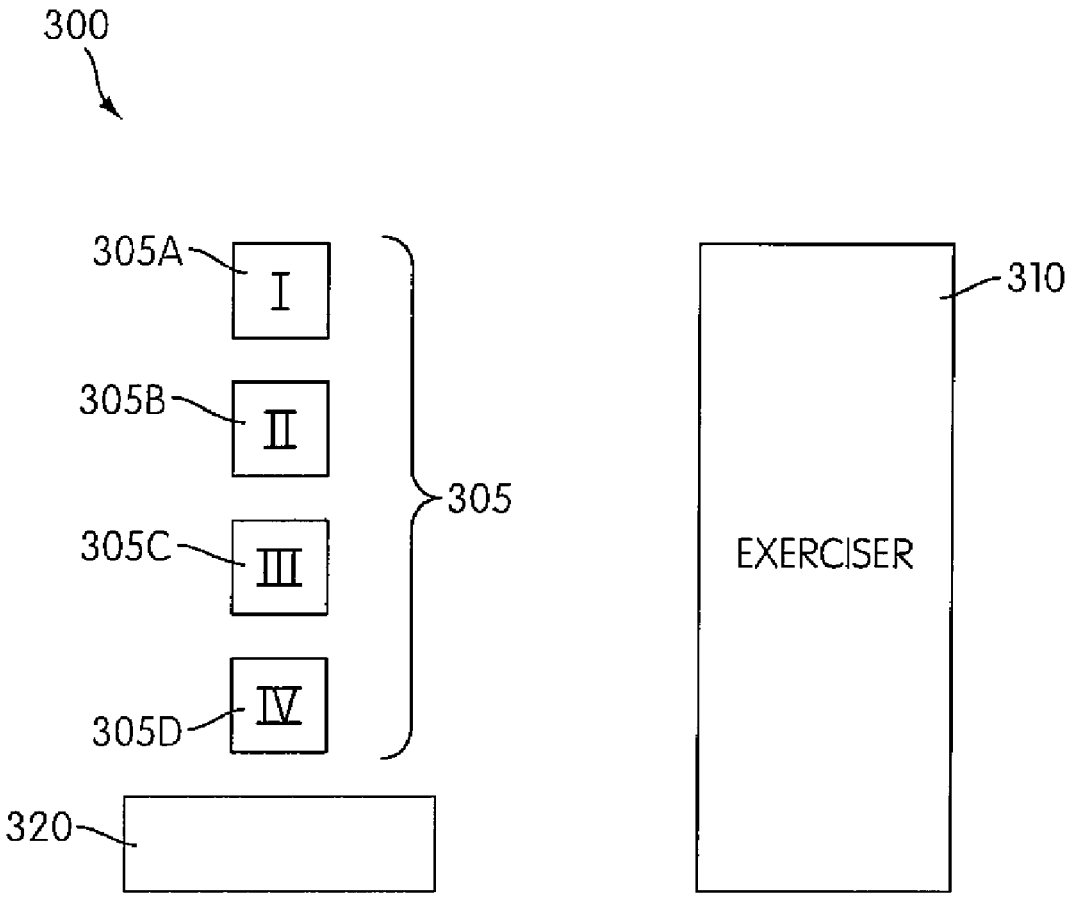
FIG. 7 is a schematic of an exercising system according to embodiment.

FIG. 7 shows a schematic of an exercising system 300 according to an embodiment. Different users may have different skills and/or wish or desire to have a resilient foot support having different tension, resilience, or bouncing characteristics. Accordingly, a set 305 of different resilient foot supports may be provided. For instance, as shown, the set 305 may include four resilient foot supports, 305A, 305B, 305C, and 305D. As many resilient foot supports may be provided as desired, according to one or more disclosed embodiments. The resilient foot supports 305A, 305B, 305C, and 305D may provide users with different tensions, resiliency or bouncing characteristics. Each resilient foot support may include its own frame, or some or all of the resilient foot supports may use or share the same frame (e.g., frame 50). For example, one or more sheet assemblies 80 and 90 of releasable resilient foot support systems 100 and 200, respectively may share the same frame 50. Alternatively, each resilient foot assembly may have its own frame 50.

A rack or other storage system 320 may also be provided to conveniently store the set 305 of foot supports, when they are not being used. In addition, the set 305 may include indicia to let users know the properties of each foot support. Indicia may include, for instance, numbering, text, color-coding, etc. to readily identify the tension, resiliency, and/or bouncing characteristic thereof.

In some embodiments, an exerciser 310 may be provided with a set 305 of resilient foot supports. The exerciser 310 may accommodate multiple users having different skill levels or requirements. Users may select a resilient foot support from the set 305 for use with the exerciser 310. Of course, it will be appreciated that in other embodiments, the set 305 may be used with or without the exerciser 310. For example, the resilient foot support selected by the user may attach to a frame of the exerciser 310, similarly as disclosed above, with respect to exerciser 10 (FIG. 1).

Although the invention has been described with respect to certain embodiments, those of ordinary skill in the art will realize that modifications may be made within the scope of the invention.

What is claimed is:

1. A resilient foot support system for an exerciser of the type having a track, a frame assembly configured to orient the track parallel to or at an acute angle with respect to a ground support for the frame assembly, and a movable body support mounted to be movable along said track towards and away from the resilient foot support system, the resilient foot support system comprising:

a rigid frame including a connector structure constructed and arranged to connect the rigid frame to the frame assembly of the exerciser such that the rigid frame extends in a direction that is not parallel to the ground support;

a replaceable sheet assembly configured to removably and reattachably engage the rigid frame to provide an associated resilience for the resilient foot support system, wherein the sheet assembly is constructed and arranged to be engaged by the feet of a person positioned on the movable body support and to yield resiliently, and as a result of the yielding, to provide a bouncing movement to the person as the moveable body support moves along the track parallel to or at an acute angle with respect to the ground support; and a strap having a releasable connection end, the strap being constructed and arranged to be wrapped around the rigid frame to allow the connection end of the strap to releasably connect the strap around the rigid frame.

2. The resilient foot support system according to claim 1, further comprising:

the sheet assembly is configured to slide over the rigid frame.

3. The resilient foot support system according to claim 2, wherein the sheet assembly comprises: one or more removably fasteners configured to secure the sheet assembly on the rigid frame.

4. The resilient foot support system according to claim 2, wherein the sheet assembly comprises a support member that is configured to support a flexible sheet member.

5. The resilient foot support system according to claim 4, wherein the support member comprises: one or more stiffener members configured to prevent or lessen deformation of the support member due to movement of the person.

6. The resilient foot support system according to claim 4, further comprising:

one or more coupling members positioned between the support member and the flexible sheet member.

7. The resilient foot support system according to claim 6, wherein the coupling members comprise: elastic cords or springs.

8. The resilient foot support system according to claim 2, wherein the sheet assembly comprises: one or more gussets or deformable portions that are arranged and configured to yield in order to help the sheet assembly slide over the rigid frame.

9. The resilient foot support system according to claim 2, wherein there are a plurality of straps attached around the perimeter of the replaceable sheet, each strap having a fastener and configured to wrap around the rigid frame and engage a corresponding fastener on the replaceable sheet assembly.

10. The resilient foot support system according to claim 9, wherein the fasteners on the straps and the fasteners on the replaceable sheet assembly are corresponding hook and loop fasteners.

11. The resilient foot support system according to claim 1, wherein, in coupling the replaceable sheet assembly to the rigid frame, the replaceable sheet assembly is urged into a tightened or taut condition.

12. The resilient foot support system according to claim 1, further comprising: one or more fasteners configured to releasably and removably couple the replaceable sheet assembly to the rigid frame.

13. The resilient foot support system according to claim 1, further comprising:

at least one additional replaceable sheet assembly configured to be removably and reattachably coupled to the rigid frame, wherein each replaceable sheet assembly has a different tension, resiliency or bouncing characteristic.

14. The resilient foot support system according to claim 13, wherein each replaceable sheet assembly includes its own rigid frame.

15. The resilient foot support system according to claim 13, wherein at least two of the replaceable sheet assemblies share the same rigid frame.

16. The resilient foot support system according to claim 13, wherein each replaceable sheet assembly includes indicia that identify the tension, resiliency, or bouncing characteristic thereof.

17. The resilient foot support system, of claim 1, further comprising snaps configured to releasably connect the strap around the rigid frame.

18. The resilient foot support system of claim 17, wherein the snaps comprise a connection snap positioned on the connection end of the strap, and an associated connection snap positioned on the replaceable sheet assembly, such that the connection snap positioned on the connection end of the strap is configured to engage the associated connection snap positioned on the replaceable sheet assembly.

19. An attachment for an exerciser of the type including a movable body support disposed on a frame assembly in a position to support the body of an exercising person in a position which allows the body of the exercising person to move with the movable body support in a direction towards or away from the attachment, and parallel to or at an acute angle with respect to a ground support for the frame assembly, while enabling the feet of the exercising person to be free to be moved with respect to the movable body support, said attachment comprising a movable foot support including:

a rigid frame including a connector structure constructed and arranged to connect the rigid frame to the frame assembly of the exerciser such that the rigid frame extends in a direction that is not parallel to the ground support;

a replaceable sheet assembly configured to removably and reattachably engage the rigid frame to provide an associated resilience for the resilient foot support system; and a strap having a releasable connection end, the strap being constructed and arranged to be wrapped around the rigid frame to allow the connection end of the strap to releasably connect the strap around the rigid frame;

wherein said replaceable sheet assembly is constructed and arranged to yield resiliently in response to the engagement of the feet of the exercising person and to provide, as a result of the resilient yielding, a bouncing movement to the person as the moveable body support moves parallel to or at an acute angle with respect to the ground support.

20. The attachment of claim 19, wherein the movable foot support further includes snaps configured to releasably connect the strap around the rigid frame.

21. The attachment of claim 20, wherein the snaps comprise a connection snap positioned on the connection end of the strap, and an associated connection snap positioned on the replaceable sheet assembly, such that the connection snap positioned on the connection end of the strap is configured to engage the associated connection snap positioned on the replaceable sheet assembly.

22. An exerciser comprising:

a frame assembly including a track;

a movable body support disposed on said track and constructed and arranged to support the body of an exercising person in a position which allows the body of the exercising person to move with the movable body support while enabling the feet of the exercising person to be free to be moved with respect to said movable body support, said movable body support being moveable on said track in a first direction away from a movable foot support and in a second direction toward said movable foot support, whereby the movable body support is configured to move along said track parallel to or at an acute angle with respect to a ground support for the frame assembly;

the movable foot support being constructed and arranged to be engaged by the feet of the exercising person supported on said movable body support, said moveable foot support comprising:

(a) a rigid frame including a connector structure constructed and arranged to connect the rigid frame to the frame assembly of the exerciser such that the rigid frame extends in a direction that is not parallel to the ground support;

(b) a replaceable sheet assembly configured to removably and reattachably engage the rigid frame to provide an associated resilience for the replaceable sheet assembly, wherein said replaceable sheet assembly includes resilient structure capable of providing a spring force in response to the engagement of the feet of the exercising person moving with the movable body support in said second direction and to establish, as a result of the spring force, a return movement by the movable foot support in said first direction which can be translated by the exercising person into a movement of said movable body support in said first direction, parallel to or at an acute angle with respect to the ground support; and (c) a strap having a releasable connection end, the strap being constructed and arranged to be wrapped around the rigid frame to allow the connection end of the strap to releasably connect the strap around the rigid frame.

23. The exerciser according to claim 22, further comprising:

the replaceable sheet assembly is configured to slide over the rigid frame.

24. The exerciser according to claim 23, wherein the sheet assembly comprises: one or more removably fasteners configured to secure the sheet assembly on the rigid frame.

25. The exerciser according to claim 23, wherein the sheet assembly comprises a support member that is configured to support a flexible sheet member.

26. The exerciser according to claim 25, wherein the support member comprises: one or more stiffener members configured to prevent or lessen deformation of the support member due to movement of the person.

27. The exerciser according to claim 23, wherein the sheet assembly comprises: one or more gussets or deformable portions that are arranged and configured to yield in order to help the sheet assembly slide over the rigid frame.

28. The exerciser according to claim 22, wherein the resilient structure comprises:

one or more coupling members positioned between the rigid frame and the replaceable sheet assembly.

29. The exerciser according to claim 28, wherein the coupling members comprise: elastic cords or springs.

30. The exerciser according to claim 22, wherein, in coupling the replaceable sheet assembly to the rigid frame, the replaceable sheet assembly is urged into a tightened or taut condition.

31. The exerciser according to claim 22, further comprising:

one or more fasteners configured to releasably and removably couple the resilient foot support system to the rigid frame.

32. The exerciser according to claim 22, further comprising:

at least one additional replaceable sheet assembly configured to be removably and reattachably coupled to the rigid frame, wherein each replaceable sheet assembly has a different tension, resiliency or bouncing characteristic.

33. The exerciser according to claim 32, wherein each replaceable sheet assembly includes its own rigid frame.

34. The exerciser according to claim 32, wherein at least two of the replaceable sheet assemblies share the same rigid frame.

35. The exerciser according to claim 32, wherein each replaceable sheet assembly includes indicia that identify the tension, resiliency, or bouncing characteristic thereof.

36. The exerciser according to claim 22, wherein there are a plurality of straps attached around the perimeter of the replaceable sheet, each strap having a fastener and configured to wrap around the rigid frame and engage a corresponding fastener on the replaceable sheet assembly.

37. The exerciser according to claim 36, wherein the fasteners on the straps and the fasteners on the replaceable sheet assembly are corresponding hook and loop fasteners.

38. The exerciser according to claim 22, wherein movement of the movable body support relative to the track is restricted to linear translational movement.

39. The exerciser of claim 22, further comprising snaps configured to releasably connect the strap around the rigid frame.

40. The exerciser of claim 39, wherein the snaps comprise a connection snap positioned on the connection end of the strap, and an associated connection snap positioned on the replaceable sheet assembly, such that the connection snap positioned on the connection end of the strap is configured to engage the associated connection snap positioned on the replaceable sheet assembly.

* * * * *